United States Patent [19]

Reick

[11] 4,421,658

[45] Dec. 20, 1983

[54] HALOCARBON-SOLUBLE MOLYBDENUM COMPOSITION

[75] Inventor: Franklin G. Reick, Westwood, N.J.

[73] Assignee: Michael Ebert, New York, N.Y.

[21] Appl. No.: 362,849

[22] Filed: Mar. 29, 1982

Related U.S. Application Data

[63] Continuation-in-part of Ser. No. 218,008, Dec. 18, 1980, Pat. No. 4,349,444, which is a continuation-in-part of Ser. No. 158,329, Jun. 10, 1980, Pat. No. 4,284,518.

[51] Int. Cl.[3] ..... C10M 1/30

[52] U.S. Cl. ..... 252/32.7 E; 252/58; 252/16; 252/54.6; 252/46.4

[58] Field of Search ..... 252/32.7 E, 49.7, 16, 252/58, 464

[56] References Cited

U.S. PATENT DOCUMENTS

| | | | |
|---|---|---|---|
| 3,346,492 | 10/1967 | Hess | 252/49.7 |
| 3,840,463 | 10/1974 | Froeschmann | 252/32.7 E |
| 4,118,331 | 10/1978 | Jahnke | 252/32.7 E |
| 4,175,043 | 11/1979 | Horodysky | 252/32.7 E |

*Primary Examiner*—Jacqueline V. Howard
*Attorney, Agent, or Firm*—Michael Ebert

[57] ABSTRACT

A modified halocarbon oil composition suitable for use as a lubricant or hydraulic fluid in those applications in which conventional hydrocarbon oils constitute a fire hazard or a contaminant because of their reactive properties. The composition is formed by a chemically inert halocarbon oil having intermingled therewith an oil soluble organic molybdenum compound in an amount sufficient to afford to the composition exceptional low friction characteristics.

7 Claims, 2 Drawing Figures

80 MIN. SECTION CURVE

HALOCARBON-SOLUBLE MOLYBDENUM COMPOSITION

RELATED APPLICATIONS

This application is a continuation-in-part of my application (A) Ser. No. 218,008, filed Dec. 18, 1980, entitled "Hybrid PTFE Lubricant Including Molybdenum Compound," now U.S. Pat. No. 4,349,444, which in turn is a continuation-in-part of my application (B) Ser. No. 158,329, filed June 10, 1980, entitled "Stabilized Hybrid Lubricant," now U.S. Pat. No. 4,284,518 which application (B) relates back through still earlier-filed patent applications to my U.S. Pat. No. 4,127,491, issued Nov. 28, 1978, entitled "Hybrid Lubricant Including Halocarbon Oil." The entire disclosures of these related cases are incorporated herein by reference.

BACKGROUND OF INVENTION

This invention relates generally to halocarbon oil compositions, and more particularly to a composition suitable for use as a hydraulic fluid and lubricant in those applications in which hydrocarbon oils constitute a fire hazard or a reactive contaminant.

In modern aircraft, the hydraulic installation is largely made up of pumping equipment for supplying hydraulic fluid under pressure, a network of pipelines for distributing the pressurized hydraulic fluid, and cylinders, hydraulic motors and other devices operated by the hydraulic fluid. The hydraulic working fluid is usually mineral oil which also acts as a lubricant for the moving parts of the system.

The use of mineral oils in hydraulic aircraft systems gives rise to a serious fire hazard, especially in connection with the undercarriage or retractable landing gear mechanism of the aircraft. In the event the aircraft is forced to make a crash landing causing the belly of the craft to skid along the ground, sparks will be generated by this action; and should this landing, as is often the case, also result in the rupture of hydraulic lines causing hydraulic fluid to spurt out and be ignited by the sparks, a fire will result with highly destrictive consequences.

The designers and operators of aircraft are well aware of this problem and have sought to find effective substitutes for mineral oil as a hydraulic fluid. One approach heretofore taken has been to use a solution of glycol in water as an aircraft hydraulic fluid. While a glycol composition of this type cannot be ignited by sparks, it leaves much to be desired; for it is somewhat corrosive to hydraulic parts and has inferior lubricating properties.

The reactive properties of hydrocarbon lubricating oils is also a drawback in other applications. Thus when mechanisms used in the production and processing of microelectronic components are lubricated by hydrocarbon oil, even a slight leakage of this oil may cause a contaminating reaction with the components being worked on.

Also, a need exists in ball bearings used in cryogenic machinery, in high-pressure, screw-type compressors, in vacuum pumps and in other applications in which it is essential to avoid oxidation, of an effective non-oxidizing lubricant.

Hydrocarbon lubricants are generally not acceptable in oxidizing environments despite their excellent lubricating properties.

SUMMARY OF INVENTION

In view of the foregoing, the main object of this invention is to provide a modified halocarbon oil composition which is non-reactive and non-contaminating in the environment to which it is applicable.

More particularly, an object of this invention is to provide a modified halocarbon oil capable of acting effectively as a hydraulic fluid and lubricant in those applications in which the use of mineral oil and other hydrocarbon oils creates a fire hazard or other serious problems.

Briefly stated, these objects are attained in a composition in which a chemically-inert halocarbon oil has intermingled therewith an oil-soluble organic molybdenum compound in an amount sufficient to afford to the modified halocarbon oil exceptional low friction characteristics.

OUTLINE OF DRAWINGS

For a better understanding of the invention as well as other objects and further features thereof, reference is made to the following detailed description to be read in conjunction with the accompanying drawings, wherein:

FIG. 1 is a graph showing the relationship between temperature and time for a halocarbon oil having different percentages of an organic moly compounded added thereto; and FIG. 2 is a section taken through the curves shown in FIG. 1.

DETAILED DESCRIPTION OF INVENTION

Figure 1:
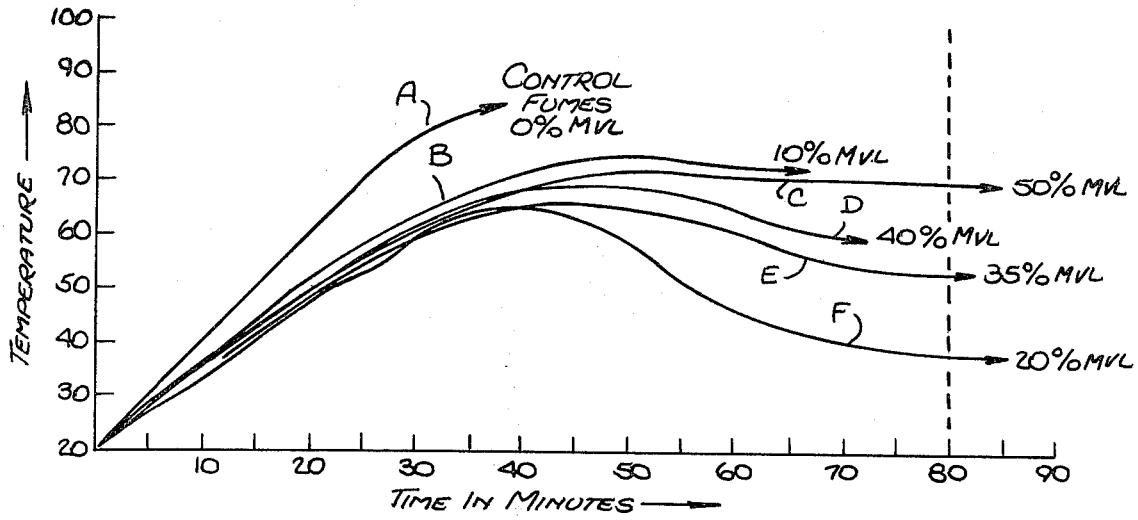

The basic ingredient of a composition in accordance with the invention is a halocarbon oil such as #10-24 and 11-21 oil produced by Halocarbon Products Corporation of Hackensack, N.J. Halocarbon oils are saturated, hydrogen-free chlorofluorocarbons that are chemically inert and have high thermal stability as well as high density and non-polar characteristics. These are made by controlled polymerization techniques and then stabilized so that the terminal groups are completely halogenated and inert.

The ability of halocarbon oils to withstand high temperature and the inertness of this oil makes this oil highly suitable as a hydraulic fluid, but for the fact that a standard halocarbon oil has lubricating characteristics distinctly inferior to mineral oil. Also, in those applications in which the parts being lubricated are exposed to oxygen, the use of reactive hydrocarbon oils is interdicted. Though halocarbon oils are suitable for this purpose, they have inferior lubricating characteristics and therefore leave much to be desired.

In order to enhance the lubricating characteristics of the halocarbon oil without otherwise degrading its useful properties, intermingled therewith is an oil soluble organic molybdenum compound in a percentage by volume sufficient to bring about a marked reduction in friction, as evidenced by the relatively little heat that is generated when the modified halocarbon oil is put to use.

The oil-soluble molybdenum compound used is of the type presently available commercially as an additive to automobile hydrocarbon lubricating oils for heavy loads and extreme pressure (EP) applications. In the present invention, this compound is intermingled with the halocarbon oil in a high-shear mixer mechanism.

One example of this compound is "MOLYVAN L," the trademarked product of the R. T. Vanderbilt Company, Inc., of Norwalk, Conn. This organic molybdenum compound is composed of molybdenum as $MoO_3$ (10.6%), sulfur (14.0%) and phosphorus (4.5%).

Another example is Elco L-28901 (mylybdenum dialkyl dithiophosphate), produced by the Elco Corporation of Cleveland, Ohio. This oil-soluble additive contains a high concentration of molybdenum in relation to phosphorus and sulfur. In the Elco compound, the molybdenum-to-phosphorus ratio is typically 5 to 1. As pointed out in the Preliminary Bulletin published by Elco, this compound is soluble in all types of lubricating oils and acts not only as an extreme pressure, anti-wear agent, but also as an antioxidant. In many instances, its activity is enhanced by the incorporation of Elco 217, a sulfurized hydrocarbon.

Other examples of oil soluble compounds based on molybdenum, such as sulphurized oxymolybdenum organophosphorodithiolate and molybdenum dithiolate, are disclosed in the article by Braithwaite and Greene, "A Critical Analysis of The Performance of Molybdenum Compounds in Motor Vehicles," appearing in Wear, Vol. 46, No. 2, pp 405–432, February 1978.

An oil-soluble organic molybdenum compound of the type commercially available does not significantly enhance the lubricating characteristics of standard lubricating oils under ordinary pressure conditions, such as those encountered in broad contact areas, and is not prescribed in the literature for such applications. We have found, however, that in certain high percentages, this compound markedly improves the otherwise deficient lubricating characteristics of halocarbon oils.

In FIG. 1, in which the graph shows time (0 to 90 minutes) plotted against temperature (20° to 100° C.), curve A represents the results of using an unmodified halocarbon oil in a four-ball friction testing machine in which the degree of friction encountered is reflected by a rise in temperature. It will be seen that the temperature rises quickly in 35 minutes to over 80° C. and continues to rise to an unacceptable level.

In curve B, the composition tested is halocarbon oil having added thereto 10% by volume of Molyvan L oil soluble molybdenum compound. It will be seen that after 60 minutes, the temperature levels off at about 70° C. and is still at this temperature at 80 minutes. The result using 50% of Molyvan L is shown in curve C which, despite its much higher percentage of the additive, gives about the same results as curve B.

Curve D shows the result of using 40% of the additive, in which case the curve at 50 minutes is at about 70° C. and then at 70 minutes levels off to about 60° C. Curve E for 35% of the additive shows a levelling off of about 55° C. at 70 minutes.

Curve F for 20% additive is the most striking; for while at 40 minutes it has risen to about 65° C., it thereafter sharply levels off, and at 80 minutes, the temperature is down to less than 40° C.

It must be borne in mind that in these tests, the effect of the additive is not immediate, and it does not take full effect until about an hour of operation of the friction test device.

Figure 2:
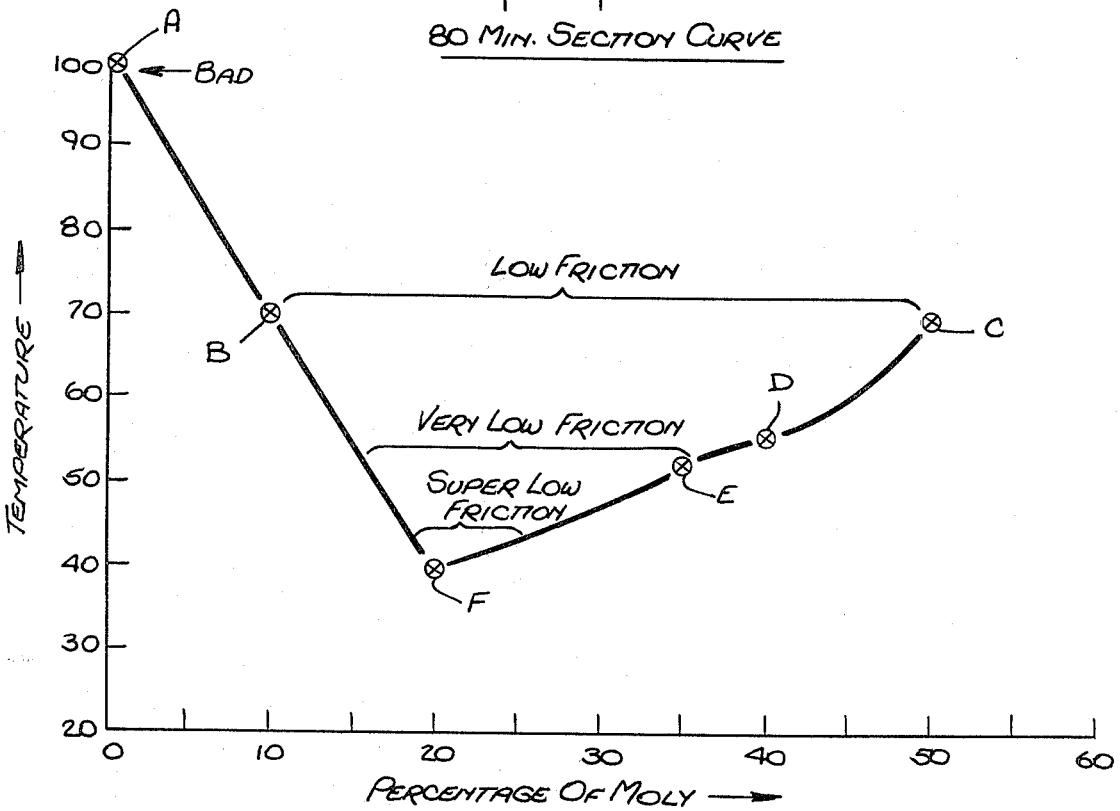

FIG. 2 is a section of the curves in FIG. 1 taken at the 80 minutes position to show the effects of different percentages of additive on the friction characteristics of the halocarbon oil. In FIG. 2, the temperature (20° to 100° C.) is plotted against the percentage of additive (0 to 50%). It will be seen that in the percentage range between 18 to 28%, the friction is extremely low, as evidenced by the remarkably low temperature of operation, the friction being lowest at 20%. At 40%, the friction is somewhat greater but still low; whereas at 10% and at 50% the friction is somewhat higher; while at 0% it is very high.

Thus the reduction in friction is not proportional to the percentage of soluble moly added to the halocarbon oil, but shows an unexpected non-linear relationship, there being a dramatic reduction in the 18 to 28% range.

While there has been shown and described a preferred embodiment of a halocarbon-soluble molybdenum compound in accordance with the invention, it will be appreciated that many changes and modifications may be made therein without, however, departing from the essential spirit thereof.

Thus while oil soluble molybdenum compounds such as MOLYVAN L is usually supplied by the manufacturer in the hydrocarbon carrier, where in severe oxygen service applications even a small amount of hydrocarbon oil in the composition cannot be tolerated, it is important to obtain from the manufacturer a soluble molybdenum compound in a halocarbon carrier. In this way, no hydrocarbon oil, even in a small amount, is present in the composition in accordance with the invention.

In some cases, it may be desirable to include in the composition a small amount of a stabilized dispersion of colloidal PTFE particles of the type disclosed in the above-identified related patent applications. The function of these PTFE particles is not primarily to enhance the lubricity of the composition but to plug capillary leaks in the mechanism in which the composition is used, such as in a hydraulic system. In this case, the PTFE particles tend to penetrate the leakage paths and cluster therein to create a plug sealing the path.

I claim:

1. A modified halocarbon oil composition capable of acting effectively as a hydraulic fluid and lubricant in those applications in which hydrocarbon oils create a fire hazard comprising a major amount of a chemically-inert halocarbon oil having lubricating characteristics inferior to hydrocarbon oils to which is added a minor amount of an oil soluble organic molybdenum compound in an amount lying within a relative volume range which results in a composition having exceptional low friction characteristics.

2. A composition as set forth in claim 1, wherein said compound is composed of molybdenum, sulfur and phosphorus.

3. A composition as set forth in claim 2, wherein said compound is molybdenum dialkyl dithiophosphate.

4. A composition as set forth in claim 1, wherein said compound is in a percentage by volume of about 18 to 28%.

5. A composition as set forth in claim 1, wherein said compound is in a percentage by weight of about 28%.

6. A composition as set forth in claim 1, wherein said molybdenum compound is dissolved in a halocarbon carrier.

7. A composition as set forth in claim 1, further including a stabilized dispersion of colloidal particles of polytetrafluoroethylene in an amount sufficient to plug capillary leaks in the hydraulic fluid mechanism in which the compositions is used.

* * * * *